US007549382B2

(12) United States Patent
Levy et al.

(10) Patent No.: US 7,549,382 B2
(45) Date of Patent: Jun. 23, 2009

(54) ON-LINE COAL FLOW CONTROL MECHANISM FOR VERTICAL SPINDLE MILLS

(76) Inventors: Edward Kenneth Levy, 1030 Raymond Ave., Bethlehem, PA (US) 18018; Harun Bilirgen, 3998 Autumn Ridge Rd., Bethlehem, PA (US) 18017; Aly Elshabasy, 6 Duh Dr., Apt. 233, Bethlehem, PA (US) 18015

( * ) Notice: Subject to any disclaimer, the term of this patent is extended or adjusted under 35 U.S.C. 154(b) by 450 days.

(21) Appl. No.: 11/385,016

(22) Filed: Mar. 20, 2006

(65) Prior Publication Data

US 2006/0225629 A1 Oct. 12, 2006

Related U.S. Application Data

(63) Continuation-in-part of application No. 10/936,401, filed on Sep. 8, 2004, now Pat. No. 7,013,815, which is a continuation-in-part of application No. 10/258,630, filed as application No. PCT/US01/12842 on Apr. 20, 2001, now Pat. No. 6,789,488.

(60) Provisional application No. 60/199,300, filed on Apr. 24, 2000, provisional application No. 60/265,206, filed on Feb. 1, 2001.

(51) Int. Cl.
*F23K 3/02* (2006.01)
*F23K 1/00* (2006.01)

(52) U.S. Cl. ..... 110/106; 110/104 R; 110/310

(58) Field of Classification Search ..... 110/309, 110/310, 106, 104 R, 232, 263, 101 R; 241/19, 241/52, 119, 79, 80, 39, 57; 461/155, 156, 461/157, 159, 160, 161, 162
See application file for complete search history.

(56) References Cited

U.S. PATENT DOCUMENTS 1,875,808 A * 9/1932 Gerquest ..... 431/114
4,459,922 A * 7/1984 Chadshay ..... 110/265
5,685,240 A * 11/1997 Briggs et al. ..... 110/106
6,092,748 A * 7/2000 Keyssner et al. ..... 241/47

* cited by examiner

*Primary Examiner*—Kenneth B Rinehart
(74) *Attorney, Agent, or Firm*—Ober/Kaler; Royal W. Craig

(57) ABSTRACT

An improved apparatus for on-line coal flow control in vertical spindle mills comprising a plurality of independently adjustable flow control elements and positioning rods that adjust the positioning of those flow control elements. Each flow control element is positioned within the discharge turret of the vertical spindle mill along the outer wall of the discharge turret proximate the entrance to its corresponding coal outlet pipe. The adjustable rods are seated on the side of the discharge turret of the coal pulverizer and are connected to the flow control element horizontally. The flow control elements can be independently rotated by +/−90 degrees about the positioning rod axis, and can also be moved back and forth in the horizontal plane. Therefore, each flow control element has two degrees-of-freedom: rotational and linear displacements. The apparatus improves boiler performance by making it possible to operate the boiler with reduced pollutant levels (e.g. NOx, CO) and increased combustion efficiency.

10 Claims, 9 Drawing Sheets

Flow Control Element is at 0 Degree Position

Flow Control Element is at 0 Degree Position

ON-LINE COAL FLOW CONTROL MECHANISM FOR VERTICAL SPINDLE MILLS

CROSS-REFERENCE TO RELATED APPLICATIONS

The present application is a continuation-in-part of U.S. application Ser. No. 10/936,401 filed Sep. 8, 2004, now U.S. Pat. No. 7,013,815, which was a continuation-in-part of U.S. patent application No. 10/258,630, filed Oct. 24, 2002 (now U.S. Pat. No. 6,789,488), which is from International PCT Application PCT/US01/12842, filed Apr. 20, 2001, corresponding to U.S. patent application Ser. No. 60/199,300, filed 24 Apr. 2000 and Ser. No. 60/265,206, filed: Feb. 1, 2001.

BACKGROUND OF THE INVENTION

1. Field of the Invention

The present invention relates to pulverized coal boilers and, more particularly, to a mechanism for directing coal flow trajectories to the corresponding outlet pipes of the vertical spindle mill with negligible effect on the pre-existing primary air flow distribution, the mechanism comprising an array of individually adjustable flow control elements positioned inside the discharge turret of the vertical spindle mill.

2. Description of the Background

Coal fired boilers utilize pulverizers to grind coal to a desired fineness so that it may be used as fuel for burners. In a typical large pulverized coal boiler, coal particulate and primary air flow from the pulverizers to the burners through a network of fuel lines that are referred to as coal pipes. Typically, raw coal is fed through a central coal inlet at the top of the pulverizer and falls by gravity to the grinding area. Once ground (different types of pulverizers use different grinding methods), the pulverized coal is transported upwards, using air as the transport medium. The pulverized coal passes through classifier vanes within the pulverizer. These classifier vanes may vary in structure, but are intended to establish a swirling flow within the rejects cone to prevent coarse coal particles from flowing into the discharge turret of the pulverizer. The centrifugal force field set up in the rejects cone forces the coarse coal particles to drop back down onto the grinding surface until the desired fineness is met. Once the coal is ground finely enough, it is discharged and distributed among multiple pulverized coal outlet pipes and into respective fuel conduits where it is carried to the burners. Each coal pulverizer is an independent system and delivers fuel (pulverized coal) to a group of burners.

In a conventional coal pulverizer 100 as shown in FIG. 1 (A & B), raw coal 101 is dropped into coal inlet port 102 and by force of gravity falls through coal chute 103 until it reaches the grinding mechanism 104. The grinding mechanism 104 grinds the coal into fine pieces. Air 105 flows into air inlet port 106 through a nozzle ring on the outside perimeter of the grinding mechanism 104, feeds primary air into the pulverizer. This creates a stream of low-velocity air that carries the particles of pulverized coal upward where they enter classifier vanes 109 that establishes a swirling flow within a reject cone 120. The centrifugal force field set up in the reject cone 120 prevents coarse pieces of coal 110 from entering the discharge turret 108. The coarse pieces of coal 110 fall by force of gravity back into the grinding mechanism 104. Once the pulverized coal 107 enters the discharge turret 108 it is distributed between the multiple equal diameter pulverized coal outlet pipes 111 (FIG. 1 shows six pulverized coal outlet pipes 111 at the top). The pulverized coal 107 is then carried by connected fuel conduits to a boiler where it is burned as fuel.

FIG. 2 is a simplified cross-section of the vertical spindle pulverizer as in FIGS. 1A&B with four outlet pipes, and FIG. 3 is a top view of FIG. 2. Poor balance of pulverized coal 107 distribution between pulverized coal outlet pipes 111 is commonly experienced in utility boilers. This can be due to various reasons, such as system resistance of each individual fuel conduit, physical differences inside the pulverizer, and coal fineness. The unbalanced distribution of coal among the pulverized coal outlet pipes adversely affects the unit performance and leads to decreased combustion efficiency, increased unburned carbon in fly ash, increased potential for fuel line plugging and burner damage, increased potential for furnace slagging, and non-uniform heat release within the combustion chamber. In addition, it is critical for low NOx (Nitric Oxides) firing systems to precisely control air-to-fuel ratios in the burner zones to achieve minimum production of NOx. The relative distribution of coal between the pulverized coal outlet pipes is monitored by either measuring the pulverized coal flow at the individual pulverized coal outlet pipes or measuring the particular flame characteristics of burning fuel discharged from the each of the burners.

The distribution of primary air throughout the coal piping network is controlled by the flow resistances of the various coal pipes. Because of differences in pipe lengths and numbers and types of elbows in each fuel line, the different coal pipes from a pulverizer will usually have different flow resistances. It is known that fixed or adjustable vanes may be used to directly divert the coal flow distribution among the outlet pipes 111. The following references describe the use of vanes to modify coal flow distribution.

U.S. Pat. No. 4,570,549 to N. Trozzi shows a Splitter for Use with a Coal-Fired Furnace Utilizing a Low Load Burner.

U.S. Pat. No. 4,478,157 to R. Musto shows a Mill Recirculation System.

U.S. Pat. No. 4,412,496 to N. Trozzi shows a Combustion System and Method for a Coal-Fired Furnace Utilizing a Low Load Coal Burner.

Finally, U.S. Pat. No. 2,975,001 issued on Mar. 14, 1961 to Davis discloses an apparatus for dividing a main stream of pulverized coal between two branch streams. (Col. 1, lines 50-52). The apparatus may be used alone or in conjunction with a conventional slotted riffle. (Col. 1, lines 70-73). The apparatus is comprised of a combination fixed and tiltable nozzle. (Col. 1, lines 50-58). The fixed nozzle is attached to the main duct leaving the pulverizer and concentrates the coal and air flow (see claims 1-5). The concentrated coal and air flow is then directed into the tiltable nozzle with the highest concentration of coal necessarily being at the nozzle centerline. The tiltable nozzle is then "tilted" in order to direct the concentrated coal and air flow into one or the other branch stream. Guide vanes may be mounted inside the tiltable nozzle; however, this patent does not disclose adjustable guide vanes. (Col. 1, lines 58-60).

All of the foregoing references teach a form of direct diversion of the coal flow, but this likewise causes direct diversion of the air flow. It is impossible using direct diversion to increase or decrease the flow of coal into a particular outlet pipe without effecting primary air flow, or vice versa.

The present invention would make it possible to increase or decrease the coal flow in any selected one of the above-described outlet pipes 111 by rotating the guide vane in the region of high particle concentration, varying the particle flow trajectories. This unique approach makes it possible to increase or decrease the flow of coal into a particular outlet pipe without effecting primary air flow. In contrast, it is very difficult with an adjustable baffle approach to simultaneously balance coal and primary air flow rates.

SUMMARY OF THE INVENTION

It is, therefore, a main object of the present invention to provide an improved apparatus for on-line coal flow control in vertical spindle mills and, specifically, for the on-line balancing and control of pulverized coal flow into the multiple pulverized coal outlet pipes of pressurized vertical spindle mills by altering the particle flow trajectories.

It is another object to eliminate coal flow imbalances at crucial points in a pulverized coal boiler system using an on-line adjustment capability that does not disturb any pre-existing primary air flow balance among the multiple coal pipes, thereby reducing pollutant emissions and improving combustion efficiency.

It is another object to simplify the coal flow balancing process and eliminate the need of adjustments to the primary air flows between the outlet pipes after achieving the desired coal flow rates between the coal pipes.

It is still another object to maintain the existing balanced coal flow distribution among the pulverized coal outlet pipes for mill load changes, eliminating the need for re-adjusting the flow control element positions as the mill coal loading changes.

It is still another object to provide an improved apparatus for on-line coal flow control in vertical spindle mills that can readily be installed within an existing pressurized vertical spindle pulverizer (within the discharge turret).

It is still another object to provide an improved apparatus for on-line coal flow control in vertical spindle mills that contributes no significant pressure drop to the flow system.

In accordance with the present invention, an improved apparatus for on-line coal flow control in vertical spindle mills is described which comprises a plurality of independently adjustable flow control elements and a means for adjusting the positioning of those flow control elements, each of which corresponds to an outlet pipe and controls the pulverized coal flow into that particular corresponding outlet pipe. Each flow control element is positioned within the discharge turret of the pulverizer at some appropriate distance from the entrance to its corresponding coal outlet pipe. Each flow control element includes an independently adjustable rod seated on the side of the discharge turret of the coal pulverizer and connected to the flow control element horizontally. The flow control elements can be independently rotated by +/−90 degrees about the positioning rod axis, and can also be moved back and forth in the horizontal plane. Therefore, each flow control element has two degrees-of-freedom: rotational and linear displacements. A combination of rotational and linear movements is used to control the coal flows in each pulverized coal outlet pipe by varying the particle flow trajectories, and the flow control elements have neutral positions at which the pre-existing coal and primary air flow distributions between the pulverized coal outlet pipes are undisturbed.

The foregoing apparatus provides on-line balancing and control of pulverized coal flows into the multiple pulverized coal outlet pipes of a pulverizer, thereby improving boiler performance by making it possible to operate the boiler with reduced pollutant levels (e.g. NOx, CO) and increased combustion efficiency.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENT

Figure 1:
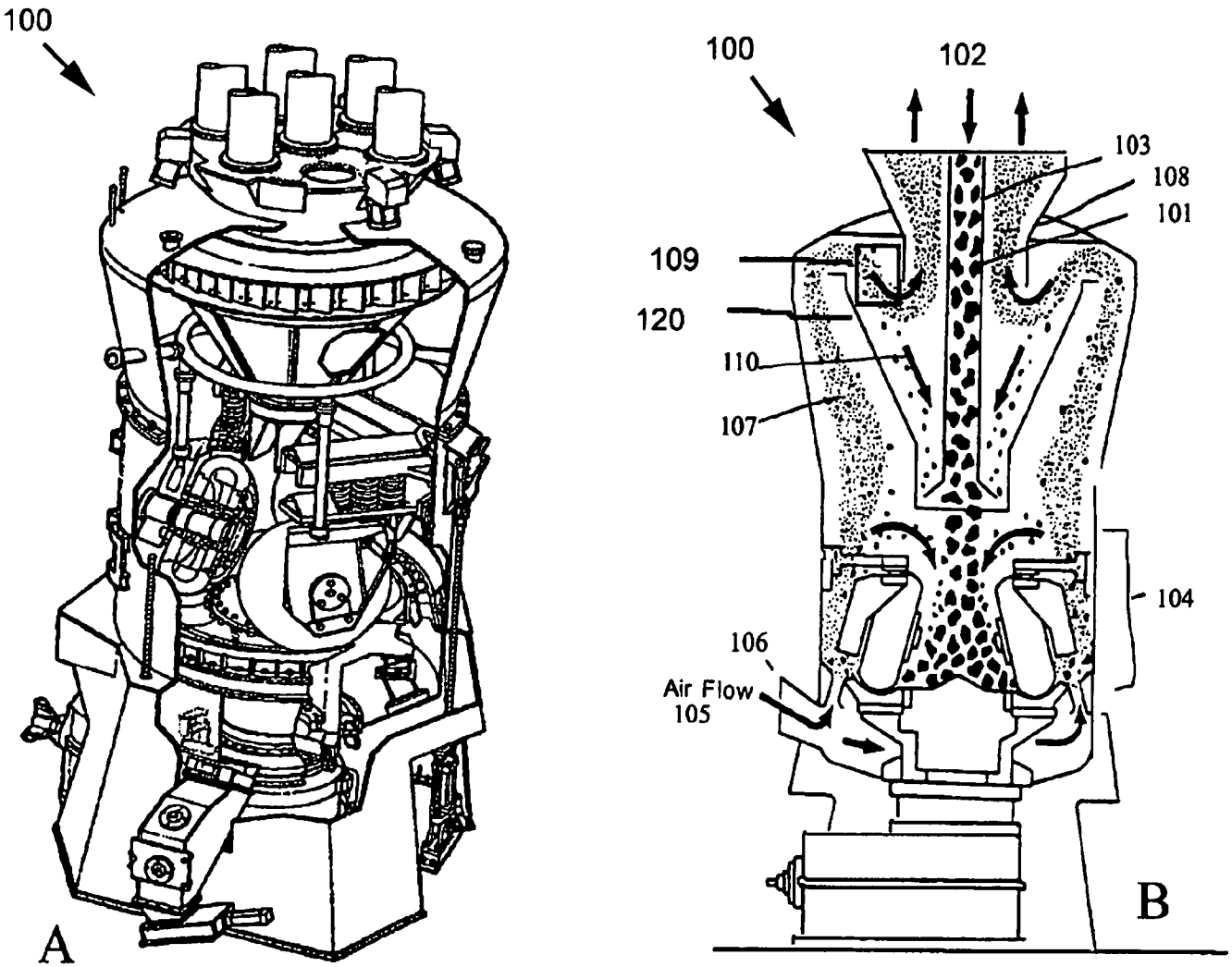
FIG 1 (Prior Art)
FIG. 1 is a prior art vertical spindle mill, FIG. 1A showing a cut-away view and FIG. 1B a cross-section.
Figure 2:
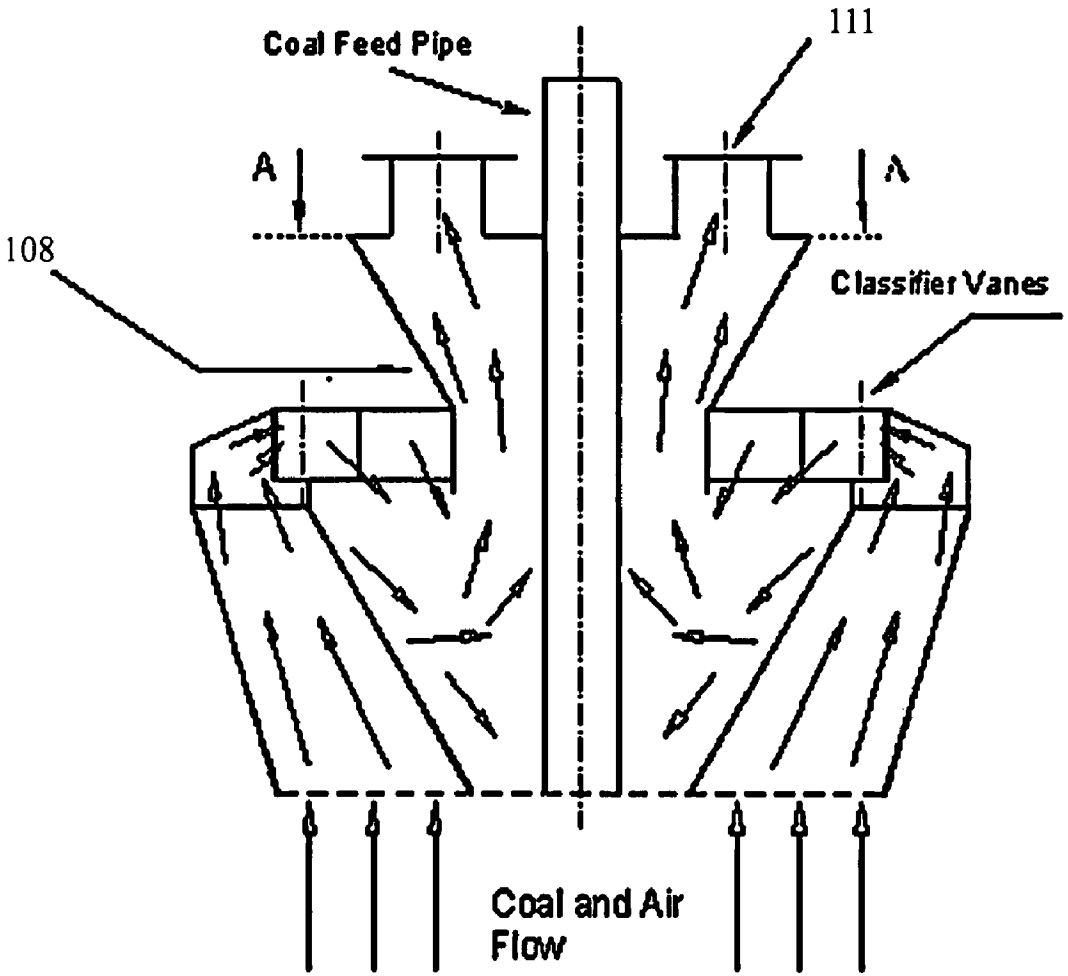
FIG. 2 (PRIOR ART)
FIG. 2 is a simplified cross-section of the prior art vertical spindle mill as in FIGS. 1A&B.
Figure 3:
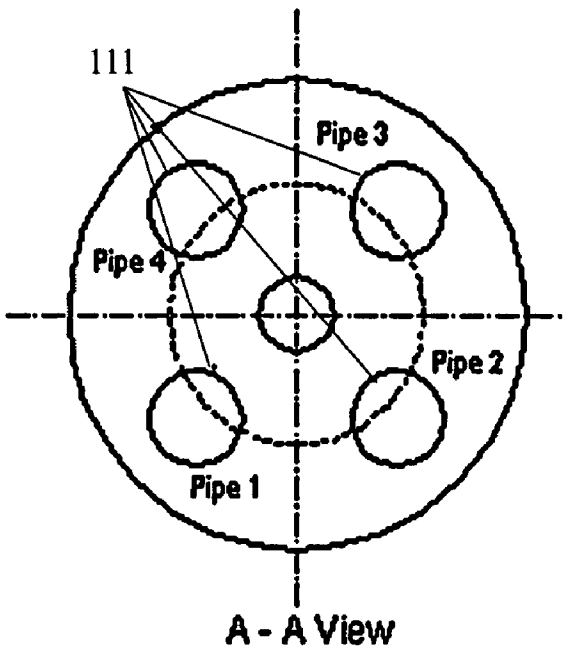
FIG. 3 (PRIOR ART)
FIG. 3 is a top view of the prior art vertical spindle mill as in FIGS. 1-2.

It is imperative for good combustion that any flow control mechanism incorporated in a vertical spindle mill as described above have little or no effect on the distribution of primary air, but most coal boilers use orifice-type restrictions in individual pipes which have a direct effect. Specifically (and referring back to FIG. 2), the air and coal particle flow structures within the discharge turret 108 determine the coal and air flow distributions between the pulverized coal outlet pipes 111. The present inventors have undertaken computational fluid dynamics (CFD) simulations to understand the coal and air flow structures within the discharge turret 108 of such a vertical spindle mill.

Figure 4:
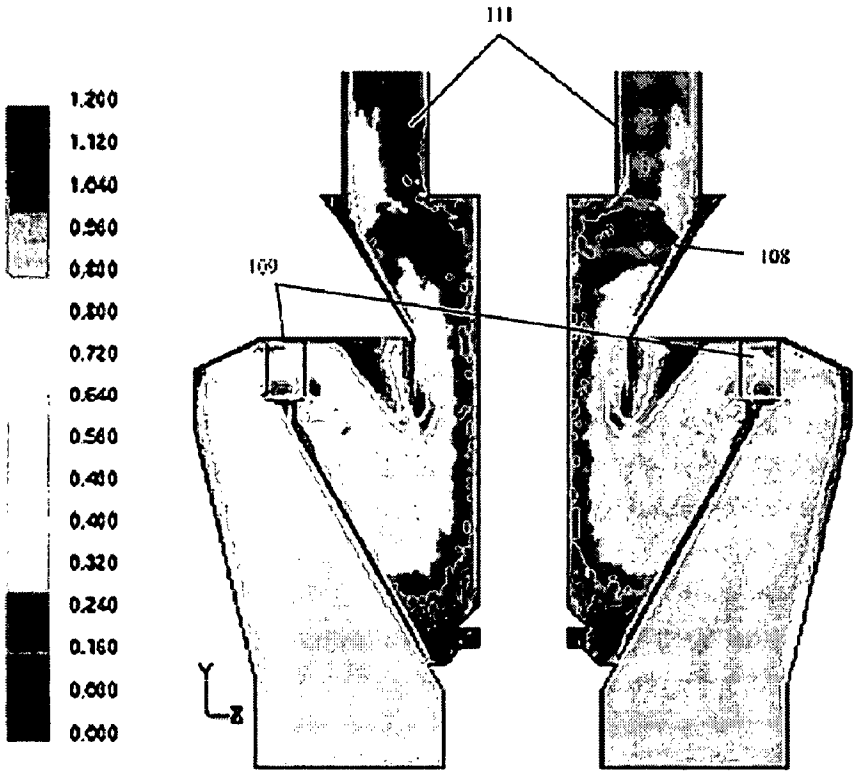
FIG. 4 depicts computational fluid dynamics (CFD) simulation results for the particulate concentration distribution in a vertical spindle mill with contour legend shown at left.

FIG. 4 depicts CFD results for the coal flow concentration distribution within the vertical spindle mill, with particle concentration mapped and indexed at left. The CFD simulation results showed a complex, 3-dimensional flow with very high radial and tangential velocity components of the air and particle flows within the discharge turret 108. The coal and air mixture makes several turns before it reaches the inlet of the outlet pipes 111. The flow mixture first makes a U-turn in the z-axis plane as it gains tangential velocity while going through classifier vanes 109 in the horizontal plane. Immediately before the discharge turret 108 inlet, the mixture makes another U-turn in the z-axis plane just before it enters the discharge turret 108. Immediately after particles enter the funnel-shaped discharge turret 108, they are forced toward the outer wall by the tangential and radial velocity components of the air flow. In a very short axial distance in the discharge turret 108 the majority of the particles accumulate in the vicinity of the discharge turret 108 outer wall. The drag force in the radial direction due to the flow expansion and the centrifugal force created by the tangential velocity within the discharge turret 108 are the major parameters that determine the particle trajectories and consequently the particle flow distribution between the outlet pipes.

Figure 5:
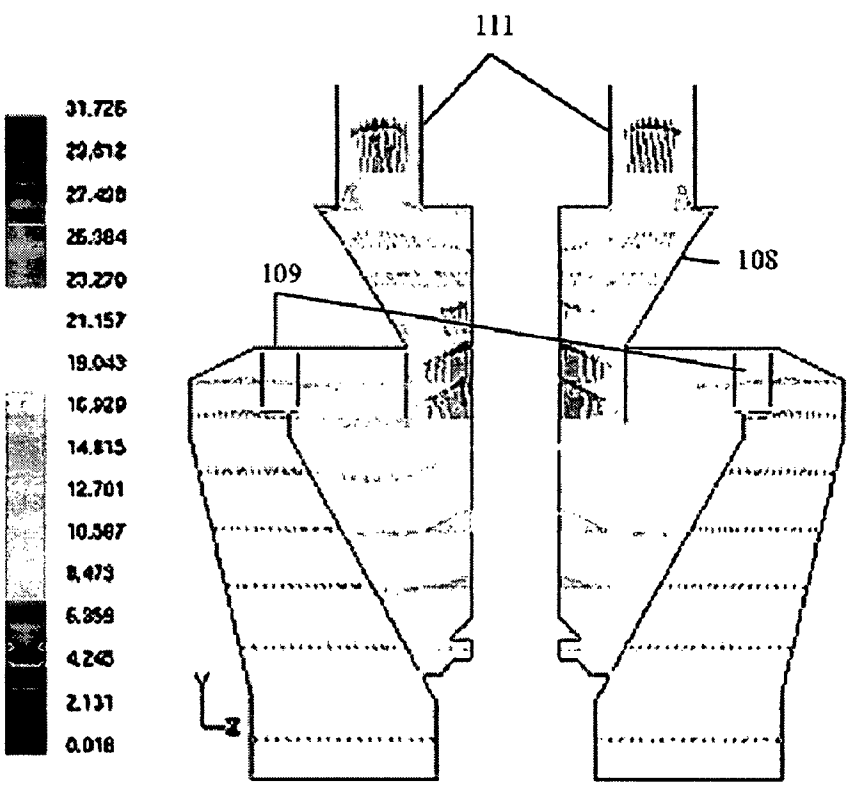
FIG. 5 depicts CFD simulation results for the velocity vector field of the air flow with velocity vector legend shown at left.

FIG. 5 depicts CFD results for the velocity vector field of the air flow. Similar to the coal flow, stratification in air flow is also observed as the air flow makes U-turns. A gradually decreasing air velocity profile from the inner to the outer wall of the discharge turret 108 is established at the inlet plane of the discharge turret 108. Phase segregation within the discharge turret 108 is initiated at the entrance of the discharge turret 108 and propagates as the mixture advances in the axial direction.

The flow in the pulverized coal pipes 111 is categorized as dilute phase pneumatic conveyance in which air and micron size particles flow together. The density of the coal particles is almost 1,400 times higher than that of the air. The particulate and air flows show significant differences when they flow together in a pipe due to this enormous density difference. The air flow can quickly respond to the geometrical changes in the pipe layout while it takes longer times for particles.

The present invention relies on the fact that a phase separation between air and coal flows occurs within the discharge turret as shown in the CFD simulation results (FIGS. 4, 5). Highly concentrated particle flow and high primary air velocity regions are established in the outer and inner walls of the discharge turret 108, respectively. This separation in the flow is due to the drag force in the radial direction caused by the flow expansion and the centrifugal force created by the tangential velocity within the discharge turret 108, which is a generally funnel-shaped conduit. In accordance with the present invention, individually-adjustable flow control elements are positioned in the region where highly concentrated particle flow exists proximate the discharge turret 108 outer wall. This allows control of the coal flow distribution by altering the particle flow trajectories (FIG. 4) without affecting the distribution of primary air (FIG. 5).

Figure 6:
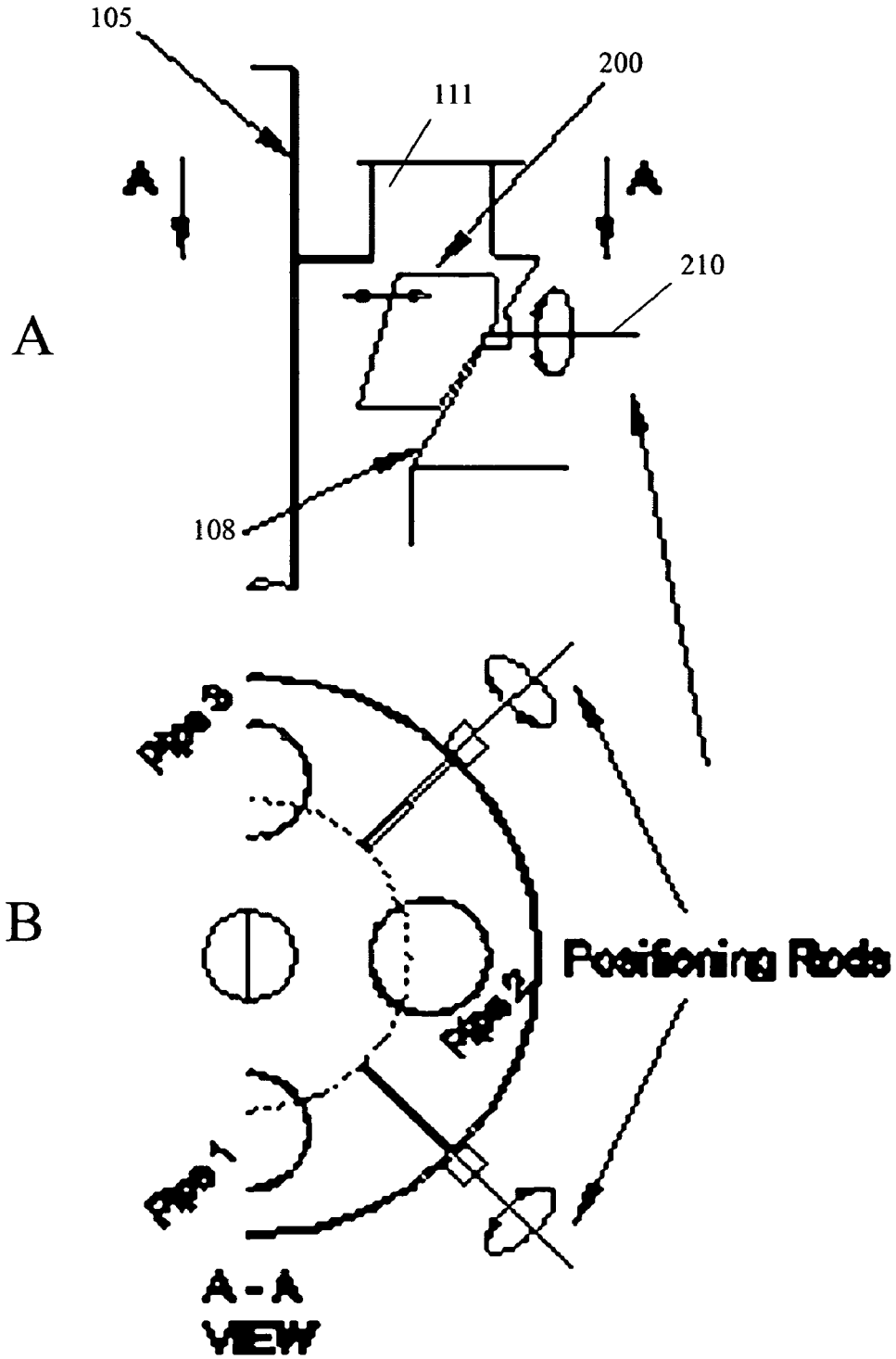
FIG. 6 is a side section view (at A) and top view (B) illustrating an array of individually adjustable flow control elements 200 (one being shown at A) positioned inside the funnel-shaped discharge turret 108 of a vertical spindle mill.

FIG. 6 is a side section view (at A) and top view (B) illustrating one embodiment of the present invention comprising an array of individually adjustable flow control elements 200 (one exemplary one being shown at A) positioned inside the funnel-shaped discharge turret 108 of a vertical spindle mill. The number of flow control elements 200 is equal to the number of pulverized coal outlet pipes 111 and each flow control element 200 corresponds to a particular pulverized coal outlet pipe 111. The flow control elements 200 are each positioned upstream of a corresponding pulverized coal outlet pipe 111, generally toward the middle or top of the discharge turret 108, and thereby direct coal flow to the corresponding outlet pipes 111. As will be described, the geometry, position and orientation of the flow control elements 200 are optimized in such a way that the coal flow rate adjustments between the outlet pipes 111 has negligible effect on the pre-existing primary air flow distribution in the pulverized coal outlet pipes 111.

Each individual flow control element 200 is mounted on an articulated positioning rod 210 which is pivotally and slidably seated inside the wall of the discharge turret 108, passing there through to the corresponding flow control element 200 for attachment thereto. The independently adjustable positioning rods 210 are fixedly connected to the flow control element 200 horizontally. Thus, each positioning rod 210 allows axial rotation of the flow control element 200 about the axis of the rod 210 by +/−90 degrees, as well as linear movement along the axis of the rod 210 in and out in the horizontal plane for making adjustments to the coal flows in the corresponding coal pipe 111. Preferably, the flow control elements 200 can each be independently rotated by +/−90 degrees about the positioning rod 210 axis. As illustrated, the presently-preferred shape of the flow control elements 200 is a substantially flat plate having an oblique trapezoidal shape, the oblique angle conforming to the slope of the discharge turret outer wall 108. The upper-outer edge of each flow control element 200 is truncated (such as rounded) to allow at least +/−90 degree rotation without obstruction when fully retracted against the discharge turret 108 outer wall. The flow control element 200 position is considered to be 0 degrees when it is positioned vertically (inline parallel to the outlet coal pipes 111) FIG. 6 illustrates the flow control elements 200 in their neutral 0 degree position.

Figure 7:
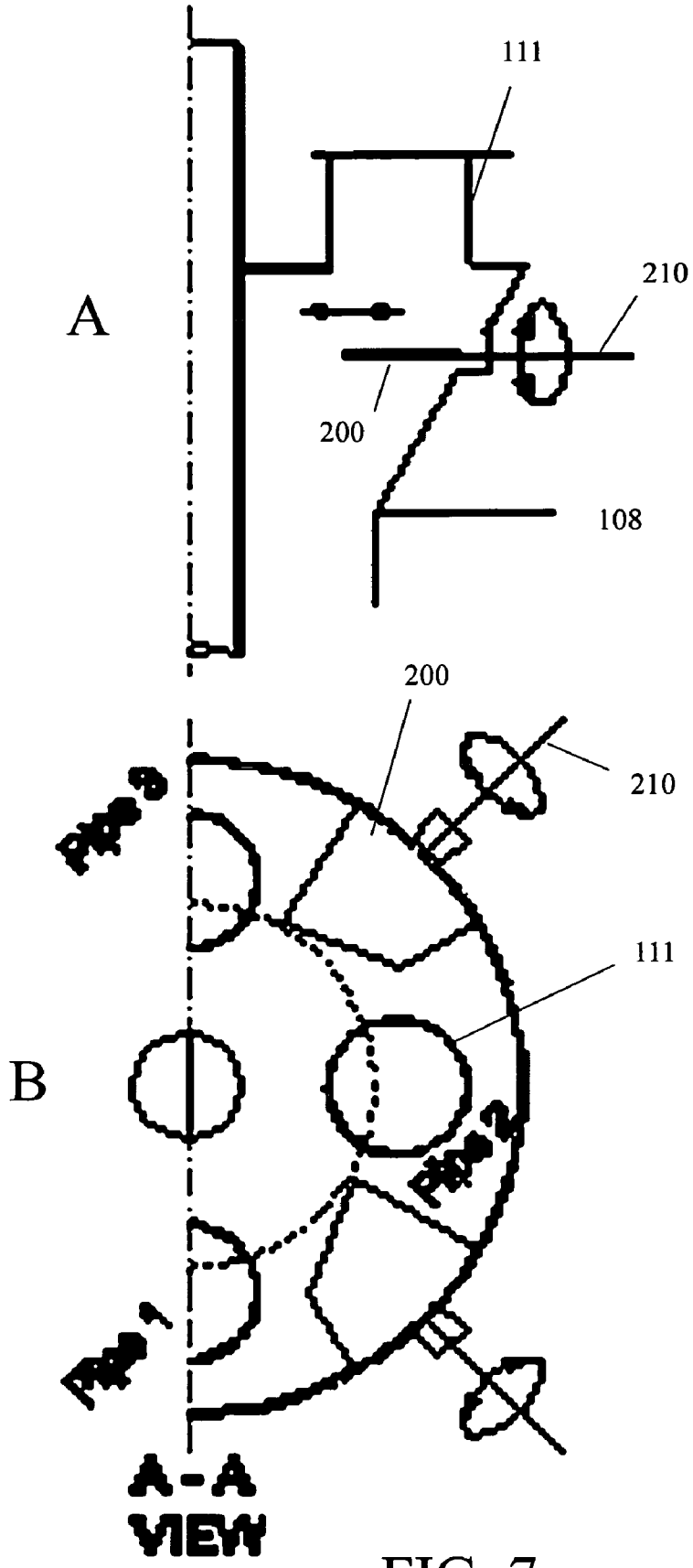
FIG. 7 is a side section view (at A) and top view (B) illustrating flow control element 200 as in FIG. 6 but rotated to a +/−90 degree position.

FIG. 7 is a side section view (at A) and top view (B) illustrating flow control element 200 as in FIG. 6 but rotated to a +/−90 degree position.

Figure 8:
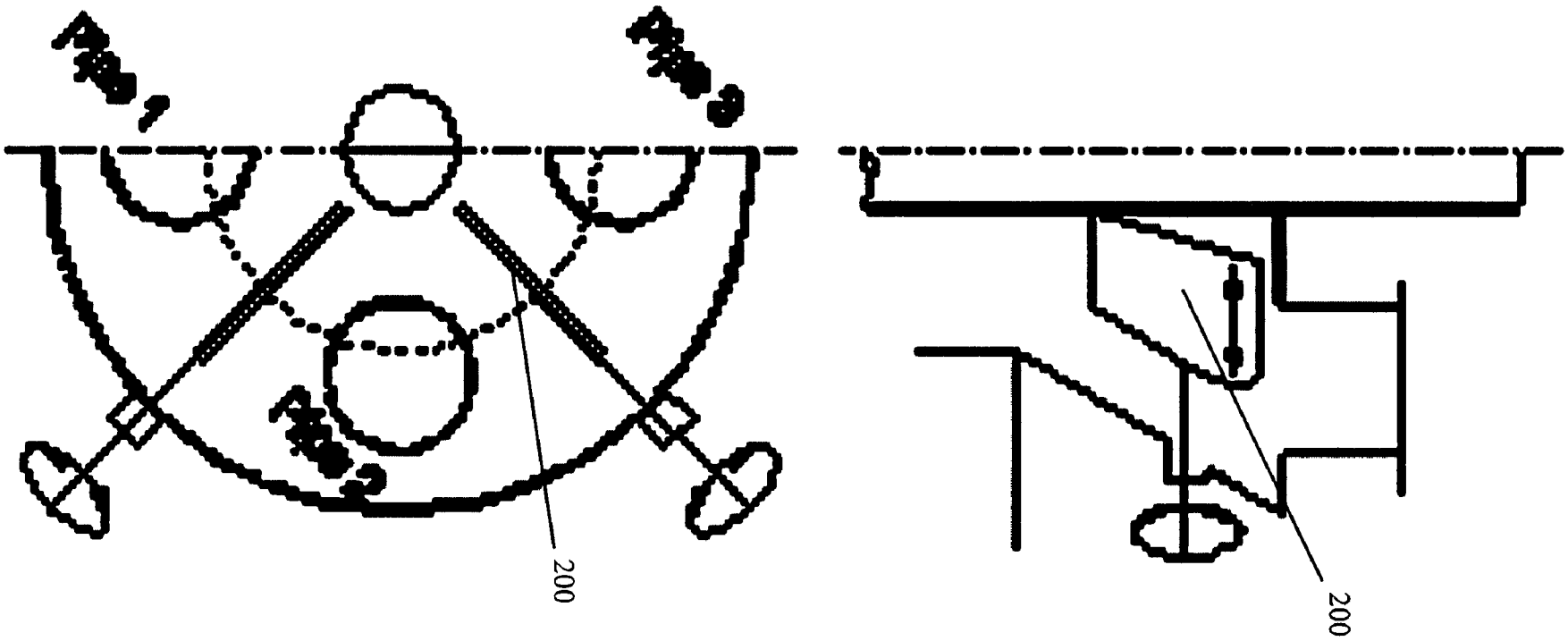
FIG. 8 is a side section view (at A) and top view (B) illustrating flow control element 200 as in FIG. 6 in a 0 degree position but displaced inward by axial movement of rod 210.

FIG. 8 is a side section view (at A) and top view (B) illustrating flow control element 200 as in FIG. 6 in a 0 degree position but displaced inward by axial movement of rod 210. It is noteworthy that moving the flow control elements 200 in and out in the horizontal plane as in FIG. 8 may not be necessary in some applications.

The preferred shape, size, and geometrical details of the flow control elements 200 as well as the preferred distance from the entrance to the pulverized coal outlet pipes 111 to the flow control elements 200 were quantitatively determined by laboratory tests using a laboratory scale vertical spindle mill type pulverizer having four outlet pipes 111 and configured with four flow control elements 200. During the experiments both the distribution of pulverized coal into the individual pulverized coal outlet pipes and primary air flow were monitored. The results indicated that the positioning the flow control elements 200 within the discharge turret 108 upstream of the entrance to the pulverized coal outlet pipes 111 provides the most efficient method for controlling the distribution of pulverized coal flows among the outlet pipes while having a negligible effect on air flow distribution.

Figure 10:
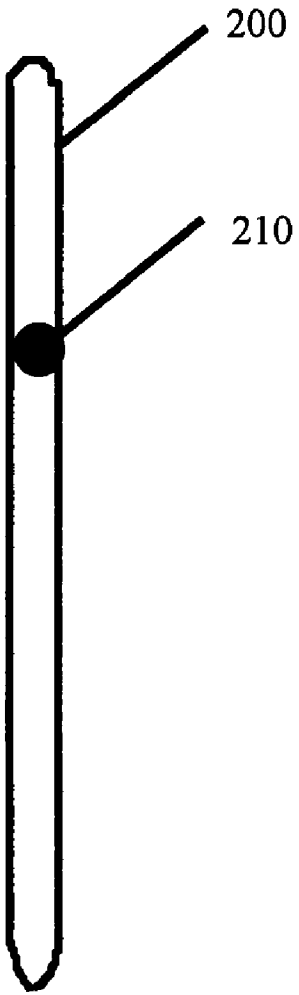
FIG. 10 is a front view of the flow control element 200 with adjustment rod 210 as in FIG. 9.
Figure 9:
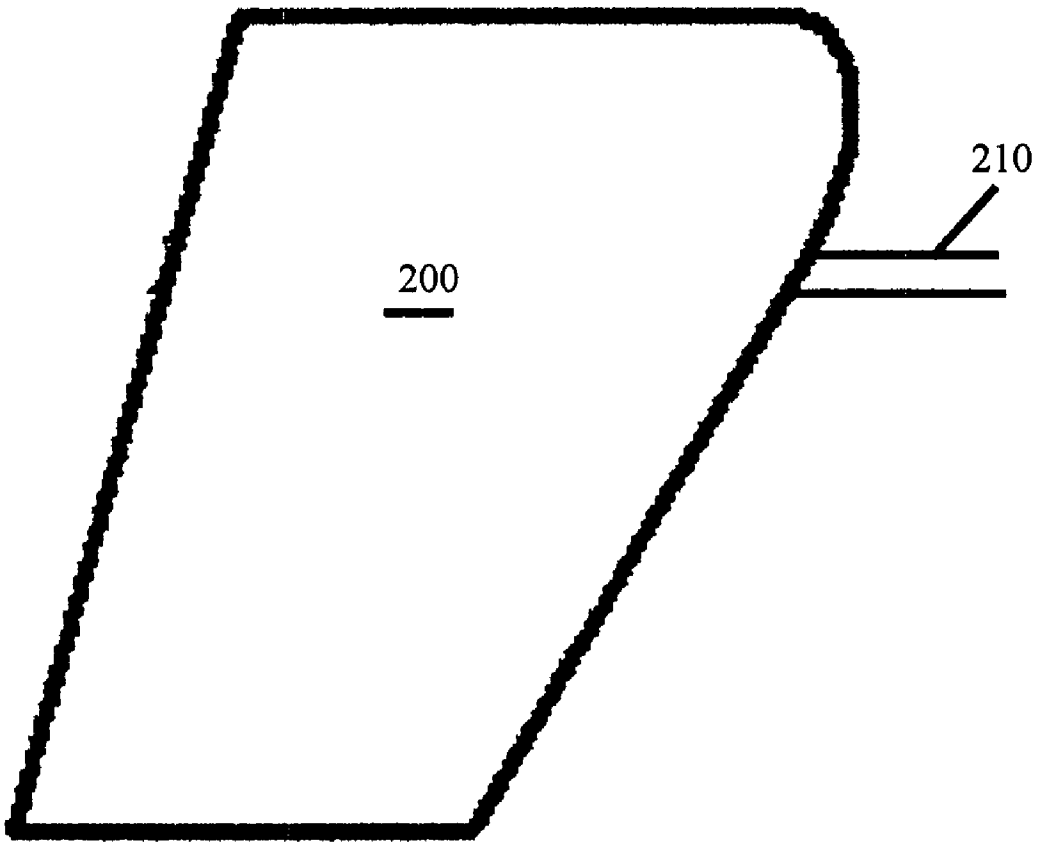
FIG. 9 is a side view illustrating the shape and relative dimensions the presently-preferred flow control element 200 with adjustment rod 210.

FIG. 9 is a side view illustrating the shape and relative dimensions the presently-preferred flow control element 200 with adjustment rod 210, and FIG. 10 is a front view. As stated above, the presently-preferred flow-control element 200 is an oblique trapezoid. The top-right corner of the flow control element is rounded to make the flow control element fit inside the discharge turret 108. Of course, other flow control element 200 shapes are possible such as contoured instead of flat plate and with shapes other than trapezoidal. The goal is the creation and control of a wake region within the highly concentrated particle flow and high primary velocity regions between the outer and inner walls of the discharge turret 108 as to alter the particle flow trajectories. Thus, the flow control elements 200 are positioned in the region where highly concentrated particle flow exists at the discharge turret 108 outer wall.

In all cases the shape, size, and distance of the flow control elements from the outlet pipes may be predetermined by testing and cataloging the results for a particular pulverizer in light of the different dimensions and internal configuration of the particular pulverizer. Test results confirm the effectiveness of the present invention in controlling the coal flow distribution, without affecting the pre-existing air flow distribution.

Figure 11:
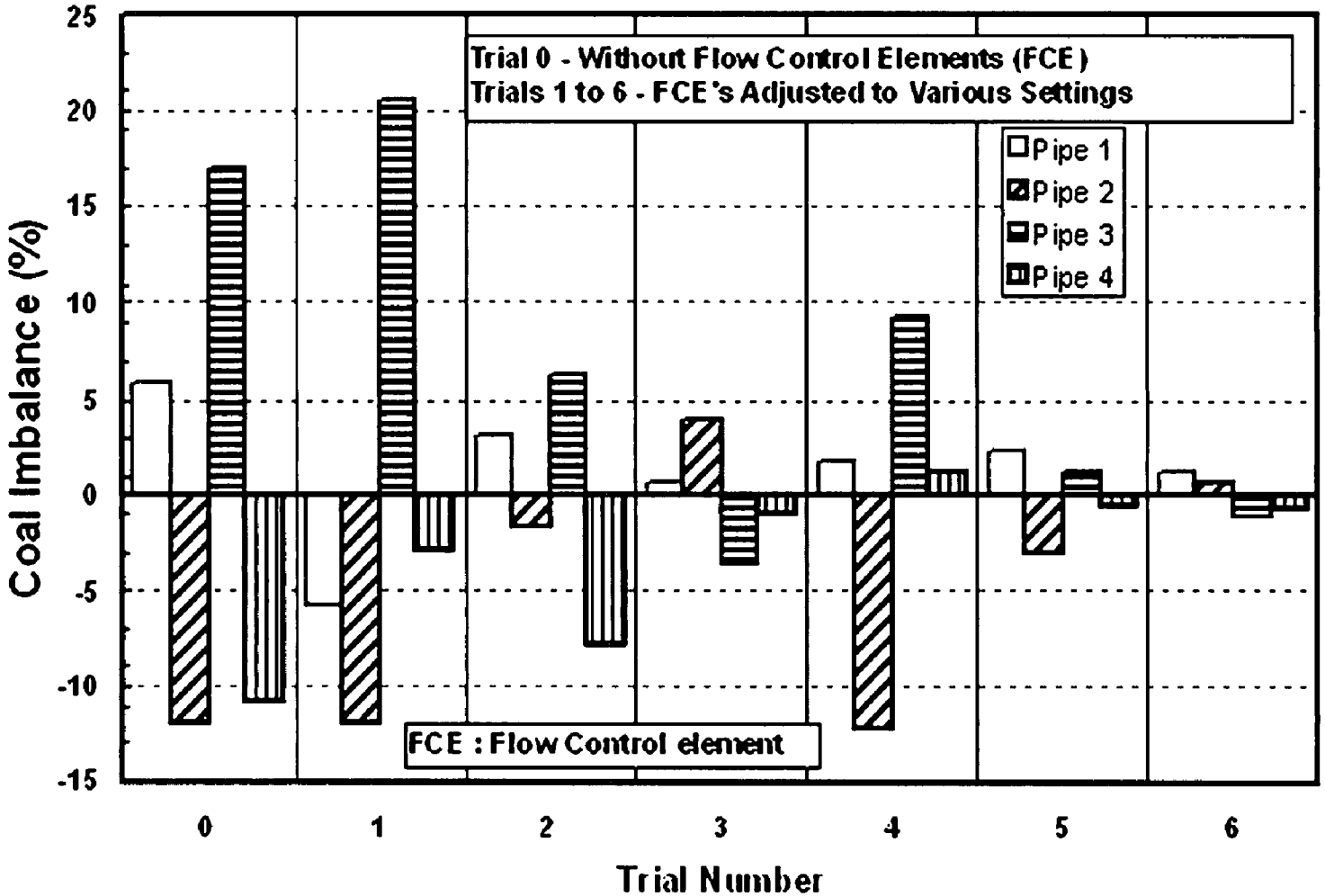
FIG. 11 illustrates the percentage of pulverized coal flow imbalance between the outlet pipes with and without the flow control elements 200.

FIG. 11 illustrates the percentage of pulverized coal flow imbalance between the outlet pipes with and without the flow control elements. A number of trials were completed to balance the coal flows between the pulverized coal outlet pipes by adjusting the flow control elements 200 individually.

Figure 12:
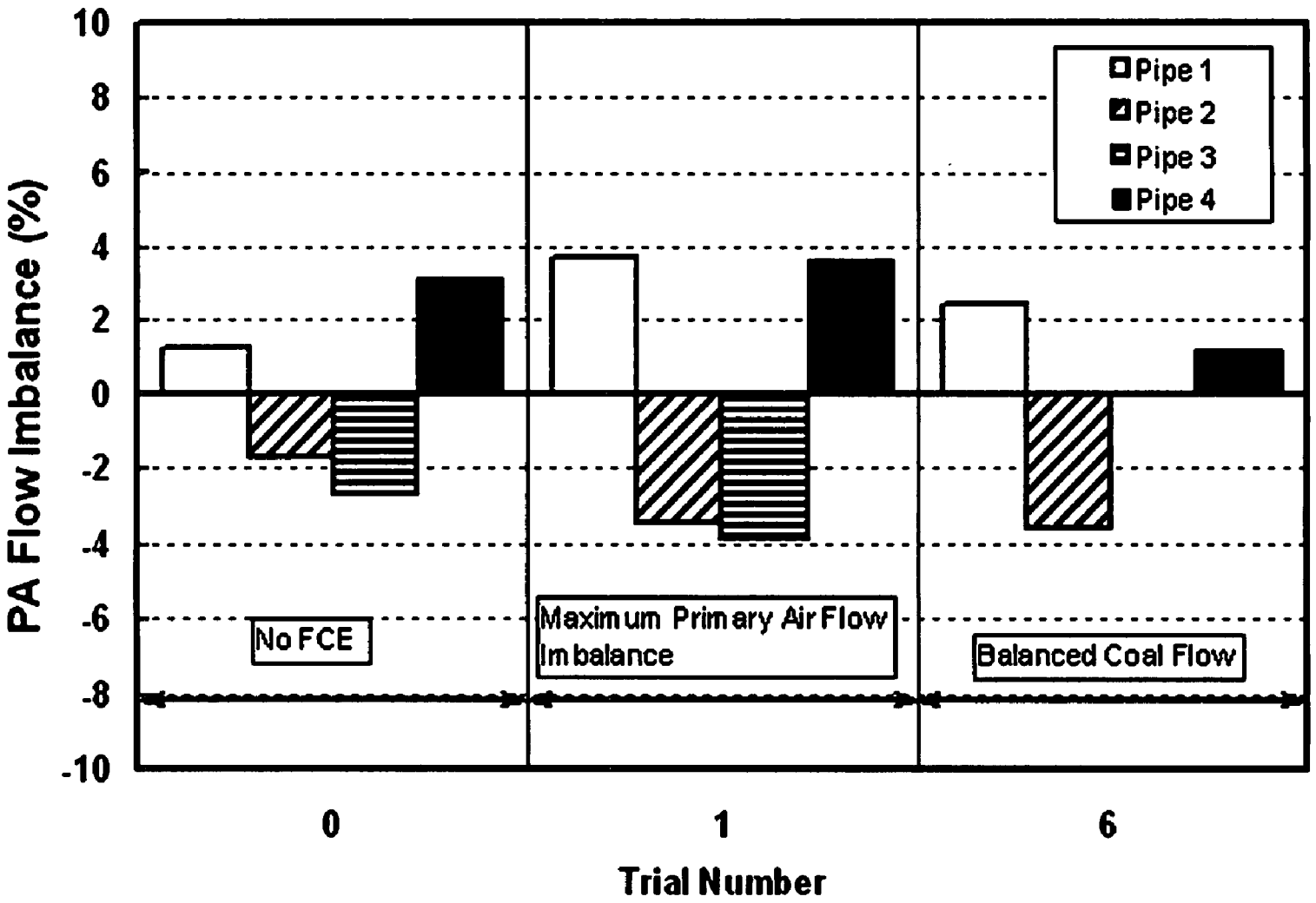
FIG. 12 is a comparative graph showing the effect on primary air flow distribution both with and without the flow control elements 200.

FIG. 12 is a comparative graph of the results of the laboratory experiments showing the effect on primary air flow distribution when the pulverizer was configured both with and without the flow control elements 200. During the coal flow balancing process, the maximum primary air flow imbalance was within +/−4.0 percent (trial # 1). For the case where there was no flow control element installed, the imbalance in the primary air flow between the pulverized coal outlet pipes was less than +/−3.0 percent (trial # 0). There was no measurable effect of coal flow balancing on the primary air flow distributions between the coal outlet pipes 111 (trial # 6).

With combined reference to FIGS. 11 and 12, more than twenty percent change in coal flow rate was achieved with the flow control elements 200 (FIG. 11) while the maximum change in the primary air flow was less than 5 percent (FIG. 12).

Laboratory experiments were also performed to investigate the effect of coal flow loading on the effectiveness of the present invention. The experiments were performed for a coal flow loading range of +/−30 percent at a constant primary air flow rate. Coal flow loading variations within +/−30 percent were found to have a negligible effect on the existing coal and primary air flow distributions once the coal flow rates between the pulverized coal outlet pipes were balanced. The coal and the primary air flow imbalances between the outlet pipes remained within +/−5.0 percent. This is a very useful feature of the present invention since it eliminates the need for re-adjusting the flow control element positions as the mill coal loading changes. In addition, no noticeable increase in pressure drop due to the flow control elements and their adjustments was measured during the experiments.

It is also noteworthy that in some vertical spindle mills, there are two, three, or more outlet streams. It should be understood that the present invention encompasses system configurations in addition to those described above (for 2-8 outlet pipes 111).

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. In a vertical coal pulverizer having a discharge turret for expelling pulverized coal particles, said discharge turret having with an inner wall and funnel-shaped outer wall with oblique slope, and plurality of pulverized coal outlet pipes leading outward from the outer wall of said discharge turret, a device for balancing and controlling the distribution of pulverized coal particles into the plurality of outlet pipes without substantially affecting the distribution of primary air flow, comprising:

a plurality of adjustable coal-flow-diverting guide-vane flow control elements each being spaced upstream of a corresponding one of said plurality of outlet pipes within said discharge turret in a region of highly concentrated particle flow resulting from a phase separation between air and pulverized coal particle flows occurring within the discharge turret to alter trajectories of the pulverized coal particles within the discharge turret thereby altering flow rate of the pulverized coal flow into the corresponding outlet pipe, and each of said plurality of coal-flow-diverting guide-vane flow control elements comprising a plate having an angled edge positioned within said discharge turret of said pulverizer proximate said outer wall in a region of highly concentrated particle flow resulting from a phase separation between air and coal flows occurring within the discharge turret, and rotatable by at least +/−90 degrees along an axis running perpendicular to said corresponding outlet pipe from a vertical orientation in which said angled edge conforms to said oblique slope of said discharge turret outer wall to a horizontal position;

a corresponding plurality of adjustment rods each pivotally seated in the outer wall of said discharge turret along an axis running perpendicular to said corresponding outlet pipe and each attached to one of said plurality of coal-flow-diverting guide-vane flow control elements; and said corresponding plurality of adjustment rods allows for independent adjustment of the position of each coal-flow-diverting guide-vane flow control element relative to said plurality of outlet pipes to selectively vary the pulverized coal particle flow trajectories without causing a significant pressure drop or affecting primary air flow distribution inside said discharge turret, thereby selectively altering a mass flow rate of the pulverized coal flow into the corresponding outlet pipes.

2. The device for balancing and controlling the distribution of pulverized coal into the plurality of outlet pipes of claim 1, wherein said plurality of adjustment rods are each slidably seated in the outer wall of said discharge turret for combined rotational and linear movement of said coal-flow-diverting guide-vane flow control elements.

3. The device for balancing and controlling the distribution of pulverized coal into the plurality of outlet pipes of claim 1, wherein the shape of each coal-flow-diverting guide-vane flow control element comprises a geometrical shape from among the group consisting of trapezoids, triangles, rectangles, squares and ellipses.

4. The device for balancing and controlling the distribution of pulverized coal into the plurality of outlet pipes of claim 3, wherein an uppermost corner of each coal-flow-diverting guide-vane flow control element proximate said discharge turret is truncated to allow said at least +/−90 degree rotation without obstruction.

5. The device for balancing and controlling the distribution of pulverized coal into the plurality of outlet pipes of claim 2, wherein said plurality of coal-flow-diverting guide-vane flow control elements are each positioned an equal predetermined distance upstream of the entrance to said outlet pipes.

6. The device for balancing and controlling the distribution of pulverized coal into the plurality of outlet pipes of claim 3, wherein said each of said coal-flow-diverting guide-vane flow control elements comprises rounded edges and smooth planar sides.

7. The device for balancing and controlling the distribution of pulverized coal into the plurality of outlet pipes of claim 1, wherein said adjustment rods are independently accessible from outside said pulverizer.

8. The device for balancing and controlling distribution of pulverized coal into the plurality of outlet pipes of claim 7, wherein each positioning rod is mounted in a sealed bushing in the discharge turret such that each rod may be rotated or slid back and forth within its bushing to adjust the position of the attached coal-flow-diverting guide-vane flow control element relative its to said plurality of outlet pipes.

9. The device for balancing and controlling the distribution of pulverized coal into the plurality of outlet pipes of claim 1, wherein each of said plurality of adjustable coal-flow-diverting guide-vane flow control elements corresponds to one of said plurality of outlet pipes.

10. The device for balancing and controlling the distribution of pulverized coal into the plurality of outlet pipes of claim 1, wherein the quantity of said plurality of adjustable coal-flow-diverting guide-vane flow control elements is fewer than the quantity of said plurality of outlet pipes.

* * * * *